United States Patent [19]

Kreuziger

[11] Patent Number: 4,952,065

[45] Date of Patent: Aug. 28, 1990

[54] METHOD AND APPARATUS FOR MIXING VISCOUS OR PASTY MATERIALS

[76] Inventor: Wolf-Dieter Kreuziger, Theresiengasse 17, A-1180 Vienna, Austria

[21] Appl. No.: 277,443

[22] Filed: Nov. 28, 1988

Related U.S. Application Data

[63] Continuation of Ser. No. 842,177, Mar. 21, 1986, abandoned.

[30] Foreign Application Priority Data

Mar. 21, 1985 [AT] Austria ..... 857/85

[51] Int. Cl.[5] ..... B01F 7/26; B01F 13/06; B01F 15/02

[52] U.S. Cl. ..... 366/139; 222/386; 366/195; 366/247; 366/315

[58] Field of Search ..... 366/194, 195, 286, 315, 366/138, 139, 247, 248, 249, 250, 251, 252, 253, 254; 222/386, 387, 388, 389, 390, 391, 392

[56] References Cited

U.S. PATENT DOCUMENTS

| | | | |
|---|---|---|---|
| 1,458,282 | 6/1923 | Fairbanks | 222/387 X |
| 1,632,975 | 6/1927 | Kempter | 366/286 X |
| 1,943,194 | 1/1934 | Vachoux | 366/286 X |
| 2,696,022 | 12/1954 | Steinbock et al. | 366/139 X |
| 3,756,570 | 9/1973 | Buhner | 366/315 X |
| 4,457,629 | 7/1984 | Liaw et al. | 366/286 X |
| 4,621,747 | 11/1986 | van der Velde et al. | 366/194 X |

*Primary Examiner*—Harvey C. Hornsby
*Assistant Examiner*—Scott J. Haugland
*Attorney, Agent, or Firm*—Cushman, Darby & Cushman

[57] ABSTRACT

In a mixing device for mixing viscous or pasty materials, in which device there is arranged within a mixing receptacle (1, 2) at least one mixing tool (5) on at least one rotatably supported mixer shaft (6), a pressing plate (3) is sealingly guided within the mixing receptacle and in direction of the mixer shaft (6), the mixer shaft sealingly extending through the pressing plate and being shiftable in direction of its axis. The mixer shaft (6) carries a mxing disc (5), which is arranged between the pressing plate (3) and the bottom (4) of the mixing receptacle (1, 2). In this manner, the mixed materials can be expelled by the pressing plate (3) via a discharge opening (7) arranged within the area of the bottom (4) of the mixing receptacle (1, 2), without the necessity of opening the mixing receptacle.

18 Claims, 2 Drawing Sheets

METHOD AND APPARATUS FOR MIXING VISCOUS OR PASTY MATERIALS

This is a continuation of application Ser. No. 06/842,177, filed Mar. 21, 1986, which was abandoned upon the filing hereof.

BACKGROUND OF THE INVENTION

1. Field of the Invention

The invention relates to a mixing device for mixing viscous or pasty materials, in which device there is arranged within a mixing receptacle at least one mixing tool on at least one rotatably supported mixer shaft. Such viscous pasty materials have the tendency to adhere to the mixing tool.

2. Description of the Prior Art

In known mixing devices of this kind, the materials adhering to the mixing tools must, after a mixing operation has been completed be manually removed from the tools for cleaning. Subsequently, a pressing plate must be placed on the mixing receptacle for pressing the mixed materials out of the mixing receptacle. Such operating steps are expensive and time-consuming and there is encountered the additional drawback that the mixed materials are subjected to the action of air within the mixing receptacle during the time interval required for cleaning the mixing tools. Thus, it is common for the materials to harden under the action of air before they can be pressed out of the receptacle.

SUMMARY OF THE INVENTION

It is an object of the present invention to facilitate the mixing process and the expelling of the mixed materials from the mixing receptacle. For solving this task, the invention essentially consists of a pressing plate hat is tightly guided within the mixing receptacle for being moved in direction of the mixer shaft, in that the mixer shaft sealingly extends through the pressing plate to be shiftable in the direction of its axis and in that the mixing tool is arranged between the pressing plate and the bottom of the mixing receptacle. The mixing tools are thus, already from the very beginning, between the pressing plate and the bottom of the mixing receptacle. The pressing plate forms a tight closure of the mixing receptacle and, after having finished the mixing process, the mixing tool and the pressing plate can simply be lowered to expel the mixed materials from the mixing receptacle without opening the mixing receptacle. The mixing process and the expelling process can, from the very beginning until the end, be performed the mixing receptacle having a closed condition, so that any access of air to the mixed materials is avoided, and one can do without stopping operation between the mixing process and the expelling process. Conveniently, and according to the invention, the mixing receptacle is subdivided into a bottom portion and an upper portion adapted for being tightly connected with the bottom portion, the pressing plate being sealingly guided within the upper portion and within the bottom portion. If the mixing receptacle is open, i.e. if the upper portion is removed, the materials to be mixed can be supplied into the mixing receptacle. If solid constituents are to be mixed with liquid constituents, the liquid constituents may, of course, be introduced into the mixing receptacles via supply openings if the upper portion is in its closed position. Of course, the mixing receptacle need not be subdivided into an upper portion and a bottom portion but can also be formed of a uniform receptacle into which the pressing plate is placed, after having introduced the materials to be mixed. Subdivision into a bottom portion and an upper portion is, however, operationally and constructively more favourable.

The shortest distance between the pressing plate and the bottom of the mixing receptacle is defined by the dimensions of the mixing tool or mixing tools in direction of the guided movement of the pressing plate. According to an advantageous embodiment of the invention, the mixing tool therefore has smaller dimensions in the direction of the axis of the mixer shaft than in radial direction. According to a preferred embodiment of the invention, the mixing tool is a substantially smooth disc extending vertically relative to the mixer shaft, so that the distance of the pressing plate from the bottom of the mixing receptacle is reduced to a minimum at the end of the expelling process. In this case, the arrangement is, according to the invention, such that the upper portion and the bottom portion each have the shape of a circular cylinder, and the mixing tool is a circular disc having a smaller diameter than the internal diameter of the cover portion and the bottom portion, the outer circumference of the circular disc being located at a distance from the inner wall of the upper portion and the bottom portion. On account of the shaft having arranged thereon the mixing tool being passed through the pressing plate for being shiftable in axial direction, such a circular disc can be reciprocated in direction of the axis during the mixing process, noting that the mixing materials may pass through the gap between the outer circumference of the circular disc and the inner wall of the mixing receptacle. Such a circular disc results in a good mixing effect.

Preferably, the space between the pressing plate and the bottom of the mixing receptacle can, according to the invention, be subjected to the action of reduced pressure or vacuum, respectively. Because the pressing plate tightly closes the mixing receptacle, the mixing material can be maintained under the action of reduced pressure or vacuum, respectively, during the whole mixing process and during the whole expelling process. According to the invention, the mixer shaft is conveniently vertically arranged. This is for charging the mixing materials into the mixing receptacle and also for improving the mixing operation within the mixing receptacle and with respect to the expelling process from the mixing receptacle. According to the invention, there is conveniently arranged a discharge opening at the area located adjacent the bottom.

The inventive process for operating the mixing device according to the invention essentially consists in that the material to be mixed is introduced into the bottom portion of the mixing receptacle, with the upper portion in its open condition, in that the mixing receptacle is evacuated or subjected to the action of reduced pressure with the upper portion in its closed condition, in that the pressing plate is pressed in direction to the bottom at least during part of the mixing process, in that the mixed materials are expelled via the discharge opening by means of the pressing plate after the mixing process has been finished and in that a cleaning liquid is, after the mixed materials have been expelled, sucked into the mixing receptacle via the discharge opening by means of the pressing plate.

BRIEF DESCRIPTION OF THE DRAWINGS

In the drawings, an embodiment of the present invention is schematically illustrated.

In the drawings.

DETAILED DESCRIPTION OF THE PREFERRED EMBODIMENT

Figure 1:
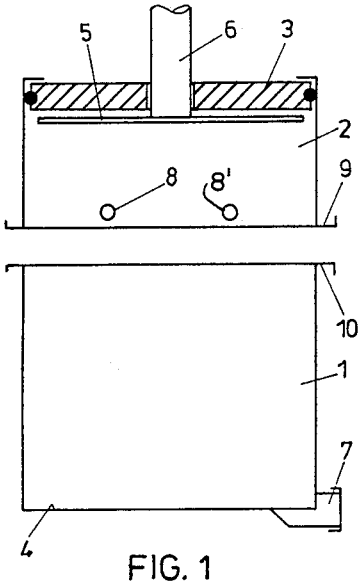
FIGS. 1 to 7 show the mixing device in various stages of the mixing and expelling process.

The mixing receptacle is subdivided into a bottom or lower portion 1 and an upper portion 2. A pressing plate 3 is tightly guided within the upper portion and can be downwardly displaced by hydraulic rams not shown. A mixing tool 5 formed of a disc is arranged between the pressing plate 3 and the bottom 4 of the mixing receptacle 1, 2 and is rotatable by means of a shaft 6. The vertical shaft 6 is sealingly guided for downward and upward shifting movement within the pressing plate 3. The mixing disc 5 is fixed to the shaft 6 in vertical relation relative to its axis. A discharge opening is provided at 7. A closeable opening 8 is provided, through which a liquid constituent 2 of the mixing materials can be introduced into the mixing receptacle 1. Flange 9 of the cover portion 2 can tightly be placed on a flange 10 of the bottom portion 1 when closing the mixing receptacle.

In FIG. 1, the mixing receptacle 1, 2 is shown in open position. The upper portion 2 is lifted off the bottom portion 1. In this position of the upper portion 2, the solid pulverulent material to be mixed 11 can be charged into the open bottom portion of the mixing receptacle 1, 2.

Figure 2:
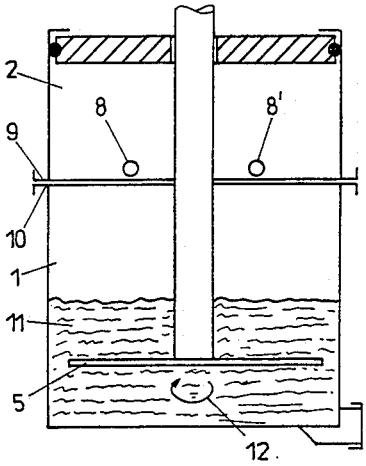

Subsequently, the upper portion 2 is lowered into the position shown in FIG. 2. The flange 9 tightly engages the flange 10. The mixing receptacle 1,2 is evacuated or subjected to the action of reduced pressure, respectively. The disc 5 is lowered. Rotation of the disc 5 can be started and is indicated by an arrow 12.

Figure 3:
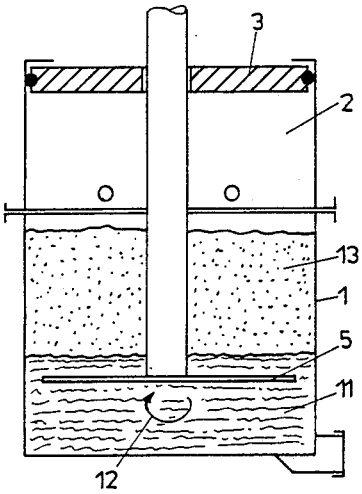

In FIG. 3, there is shown the start of the mixing process. The solid portion 11 of the mixing materials is within the mixing receptacle. The liquid portion 13 is supplied via the opening 8. In this condition, the pressing plate 3 is still in its upper position.

Figure 4:
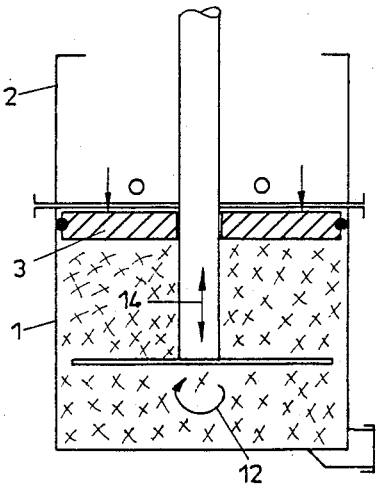

In FIG. 4, the position of the pressing plate 3 is shown in a position as when downwardly pressed. The mixing disc 5 is rotated, and the shaft is moved upwardly and downwardly in direction of the arrows 14. The solid portion 11 of the mixing materials is already mixed with the liquid proportion 13 of the mixing material. On account of the mixing receptacle 1, 2 being already evacuated, no air inclusions are present within the mixing material and the pressing plate 3 can unobstructedly be downwardly pressed with great force.

Figure 5:
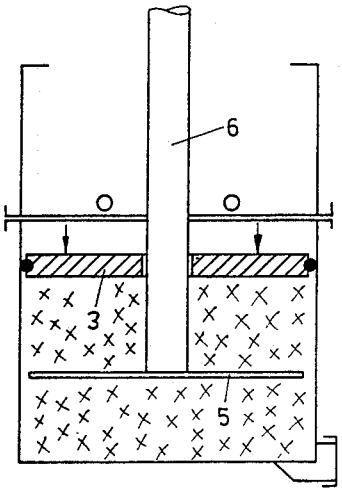
Figure 6:
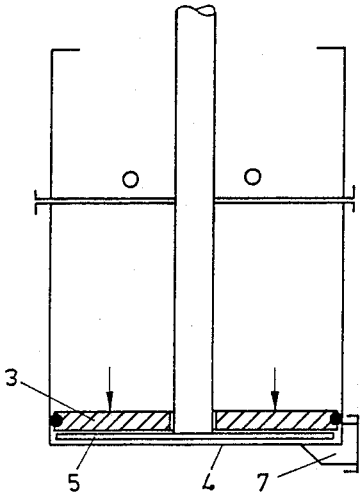

During the mixing process, the pressing plate 3 is, as is shown in FIG. 5, pressed still further downwardly. The mixing process is continued, thereby rotating and reciprocating the mixing disc upwardly and downwardly 5. After terminating the mixing process, the shaft 6 is stopped, together with the mixing disc 5. The pressing plate 3 is pressed downwardly, thereby expelling the mixed material through the discharge opening 7. The final stage of the expelling process is shown in FIG. 6.

Figure 7:
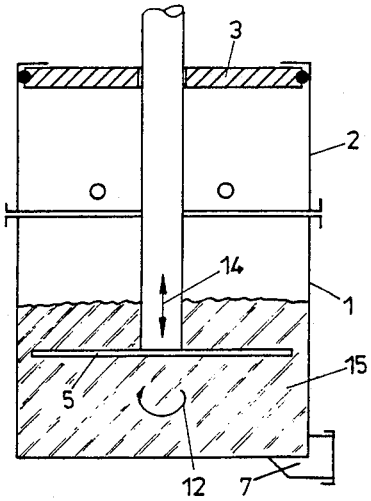

After having finished the expelling process, the pressing plate 3 is again upwardly displaced into the position shown in FIG. 7. A cleaning liquid 15, for example a solvent, is thus sucked into the mixing receptacle 1, 2 through the discharge opening 7. The mixing disc 5 is again rotated (arrow 12) and performs an upward and downward reciprocating movement (arrows 14), so that the mixing tool 5 and the mixing receptacle 1, 2 is cleaned.

Subsequently, the cleaning liquid 15 is expelled through the discharge opening 7, the pressing plate 3 and the mixing disc 5 thereby arriving in the position shown in FIG. 6. Subsequently, the pressing plate 3 is again lifted. The mixing receptacle 1, 2 is, as is shown in FIG. 1, again opened and a new charging step is begun.

What is claimed is:

1. A method of mixing viscous or pasty materials comprising: introducing solid materials into a receptable; closing the receptacle; supplying liquid components to be mixed to the receptacle; evacuating air from said receptacle; reducing the volume of the receptacle to the volume to be mixed; mixing the materials in the receptacle by a mixing tool that both rotates and reciprocates in an axial direction; expelling the materials through a discharge opening by reducing the volume of the receptacle; cleaning the receptacle by introducing cleaning fluid through said discharge opening as the volume of said receptacle is increased; agitating the mixing tool; and expelling the cleaning fluid through said discharge opening as the volume of the receptacle is decreased.

2. A method of mixing according to claim 1, wherein said decreasing and increasing the volume of said receptacle is effected by sliding a pressing plate sealingly along inner walls of said receptacle.

3. A mixing device for mixing viscous or pasty materials, comprising:

a receptacle including:

a peripheral sidewall having a cylindrical radially inner peripheral surface, said radially inner peripheral surface extending in an axial direction surrounding a longitudinal axis of the receptacle, a disc-shaped end wall joined to said sidewall and providing a closure for one end of said receptacle at one end of said sidewall, said closure having an axially inner surface located within said receptacle;

a disc-shaped pressing plate having a radially outer perimetrical edge including a perimetrically-extending seal disposed in sealing engagement with said radially inner peripheral surface of said sidewall between said one end and an axially opposite end of said sidewall, said pressing plate being disposed for axial movement towards and away from said closure, said pressing plate having an axially inner surface located within said receptacle, whereby said axially inner surface of said closure, said axially inner surface of said pressing plate, and radially inner peripheral surface of said sidewall, axially between said axially inner surfaces, provides a confined space having a volume which can be increased and decreased by axially moving said pressing plate;

means defining an opening extending axially through said pressing plate;

a rotatable and axially reciprocable shaft sealingly penetrating into said confined space from externally of said receptacle, through said opening through said pressing plate, the shaft being rotatable and axially reciprocable relative to said pressing plate;

a radially extending mixing tool mounted to said rotatable shaft and disposed in said confined space for rotation and axial reciprocation with said rotatable shaft, said mixing tool thereby including one face facing said closure and another face facing said pressing plate;

said volume of said confined space having a transverse cross-sectional area, and said mixing tool occupying less than all of said transverse cross-sectional area, so that material to be mixed in said confined space can pass axially from being located axially between said mixing tool and said closure to being located axially between said mixing tool and said pressing plate;

means defining at least one closable opening through said receptacle and into said confined space, said opening being located closer to said opposite end of said sidewall than a normal filling level of materials to be mixed in said confined space, for introduction into said confined space of materials to be mixed therein and at least one opening for pumping a vacuum on said confined space for lowering pressure therein means defining a discharge opening for said closure of said receptacle and into said confined space, so that materials mixed in said confined space can be discharged from said receptacle as a mixed material, whereby materials to be mixed can be introduced into said confined space through said at least one closable opening up to said normal filling level and mixed in said confined space by rotation and reciprocation of said shaft with said mixing tool disposed closer to said closure than said normal filling level, a partial vacuum can be drawn on said confined space, and said pressing plate can be moved axially into proximity with said closure while said discharge opening is opened, thereby using said pressing plate to expel the mixed material through the discharge opening.

4. The mixing device of claim 3, wherein:

said longitudinal axis is substantially vertically oriented, with said closure thereby providing a lower end of said receptacle.

5. The mixing device of claim 4, wherein:

said peripheral sidewall is divided intermediate said ends thereof into a lower portion and an upper portion, each said portion terminating at a respective end thereof opposite said ends of said peripheral sidewall in respective perimetrically-extending end flanges;

said upper and lower portions being separable from one another between said end flanges, thereby defining, in part, said opening means, and being sealingly closable against one another to establish and reestablish said confined space.

6. The mixing device of claim 3, wherein:

said peripheral sidewall is divided circumferentially thereof intermediate said ends thereof into one portion and another portion, each said portion terminating at a respective end thereof opposite said ends of said peripheral sidewall in respective circumferentially-extending end flanges;

said one and other portions being separable from one another between said end flanges, thereby defining, in part, said opening means, and being sealingly closable against one another to establish and reestablish said confined space.

7. The mixing device of claim 6, wherein:

said shaft is disposed coaxially of said cylindrical radially inner peripheral surface of said sidewall, on said longitudinal axis of the receptacle.

8. The mixing device of claim 7, wherein:

said opening means further include at least one closable opening provided through said peripheral sidewall.

9. The mixing device of claim 8, wherein:

said at least one closable opening provided through said peripheral sidewall is provided through the respective portion of said peripheral sidewall having said opposite end.

10. The mixing device of claim 3, wherein:

said faces of said mixing tool, said axially inner surface of said pressing plate and said axially inner surface of said closure all are substantially flat so that said pressing plate can be axially moved into close proximity to said mixing tool contemporaneously with said mixing tool being axially brought into close proximity with said closure, so that said confined space can be nearly extinguished for expelling said mixed material from said receptacle.

11. A method for mixing viscous or pasty materials, comprising:

(a) providing a receptacle including:

a peripheral sidewall having a cylindrical radially inner peripheral surface, said radially inner peripheral surface extending in an axial direction surrounding a longitudinal axis of the receptacle, a disc-shaped end wall joined to said sidewall and providing a closure for one end of said receptacle at one end of said sidewall, said closure having an axially inner surface located within said receptacle;

a disc-shaped pressing plate having a radially outer perimetrical edge including a perimetrically-extending seal disposed in sealing engagement with said radially inner peripheral surface of said sidewall between said one end and an axially opposite end of said sidewall, said pressing plate being disposed for axial movement towards and away from said closure, said pressing plate having an axially inner surface located within said receptacle, whereby said axially inner surface of said closure, said axially inner surface of said pressing plate, and radially inner peripheral surface of said sidewall, axially between said axially inner surfaces, provides a confined space having a volume which can be increased and decreased by axially moving said pressing plate, an opening extending axially through said pressing plate, a rotatable and axially reciprocable shaft sealingly penetrating into said confined space from externally of said receptacle, through said opening through said pressing plate, a radially extending mixing tool mounted to said rotatable shaft and disposed in said confined space for rotation and axial reciprocation with said rotatable shaft, said mixing tool thereby including one face facing said closure and another face facing said pressing plate, said volume of said confined space having a transverse cross-sectional area, and said mixing tool occupying less than all of said transverse cross-sectional area, so that material to be mixed in said confined space can pass axially from being located axially between said mixing tool and said closure to being located axially between said mixing tool and said pressing plate, at least one closable opening through said receptacle and into said confined space located closer to said opposite end of said sidewall than a normal filling level materials to be mixed in said confined space, for introduction into said confined space of materials to be mixed therein and at least one opening for pumping a vacuum on said confined space for lowering pressure therein to below atmospheric pressure, a discharge opening for said closure of said receptacle and into said confined space, so that materials mixed in said confined space can be discharged from said receptacle as a mixed material;

(b) introducing materials to be mixed into said confined space through said at least one closable opening, up to said normal filling level;

(c) at least partially evacuating a headspace above said normal filling level in said confined space;

(d) moving said pressing plate towards said closure sufficiently to substantially eliminate said headspace;

(e) rotating and reciprocating said shaft to mix said materials and thereby provide a mixed material in said confined space;

(f) axially moving said mixing tool into close proximity with said closure and, contemporaneously therewith, axially moving said pressing plate into close proximity with said mixing tool, while opening said discharge opening and thereby expelling said mixed material through said discharge opening.

12. The method of claim 11, further comprising:

(g) after step (f) has been conducted, reciprocating said pressing plate axially away from said closure and back into close proximity with said closure at least once, while said discharge opening is open and communicated to a supply of cleaning fluid, whereby a cleaning fluid is introduced into said confined space for cleaning said axially inner surfaces, inner peripheral surface and mixing tool, and expelled from said confined space together with remaining mixed material dislodged from said surfaces thereby.

13. A mixing device for mixing viscous or pasty materials, comprising:

a receptacle including:

a peripheral sidewall having a cylindrical radially inner peripheral surface, said radially inner peripheral surface extending in an axial direction surrounding a longitudinal axis of the receptacle, a disc-shaped end wall joined to said sidewall and providing a closure for one end of said receptacle at one end of said sidewall, said closure having an axially inner surface located within said receptacle;

a disc-shaped pressing plate having a radially outer perimetrical edge including a perimetrically-extending seal disposed in sealing engagement with said radially inner peripheral surface of said sidewall between said one end and an axially opposite end of said sidewall, said pressing plate being disposed for axial movement towards and away from said closure, said pressing plate having an axially inner surface located within said receptacle, whereby said axially inner surface of said closure, said axially inner surface of said pressing plate, and radially inner peripheral surface of said sidewall, axially between said axially inner surfaces, provides a confined space having a volume which can be increased and decreased by axially moving said pressing plate;

means defining an opening extending axially through said pressing plate;

a rotatable and axially reciprocable shaft sealingly penetrating into said confined space from externally of said receptacle, through said opening through said pressing plate, the shaft being rotatable and axially reciprocable relative to said pressing plate;

a radially extending mixing tool mounted to said rotatable shaft and disposed in said confined space for rotation and axial reciprocation with said rotatable shaft, said mixing tool thereby including one face facing said closure and another face facing said pressing plate;

said volume of said confined space having a transverse cross-sectional area, and said mixing tool occupying less than all of said transverse cross-sectional area, so that material to be mixed in said confined space can pass axially from being located axially between said mixing tool and said closure to being located axially between said mixing tool and said pressing plate;

means defining at least one closable opening through said receptacle and into said confined space, for introduction into said confined space of materials to be mixed therein and at least one opening for pumping a vacuum on said confined space for lowering pressure therein means defining a discharge opening for said closure of said receptacle and into said confined space, so that materials mixed in said confined space can be discharged from said receptacle as a mixed material, whereby materials to be mixed can be introduced into said confined space through said at least one closable opening up to said normal filling level and mixed in said confined space by rotation and reciprocation of said shaft with said mixing tool disposed closer to said closure than said normal filling level, a partial vacuum can be drawn on said confined space, and said pressing plate can be moved axially into proximity with said closure while said discharge opening is opened, thereby using said pressing plate to expel the mixed material through the discharge opening.

14. The mixing device of claim 3, wherein:

said at least one closable opening is constituted by at least two openings including at least one for introducing a solid material to be mixed and at least another for introducing a liquid material to be mixed, so that solid and liquid materials to be mixed can be separately introduced into the receptacle to be mixed in the confined space.

15. The method of claim 11, wherein:

said at least one closable opening is constituted by at least two openings including at least one for introducing a solid material to be mixed and at least another for introducing a liquid material to be mixed, so that solid and liquid materials to be mixed can be separately introduced into the receptacle to be mixed in the confined space; and in practicing step (b), a solid material and a liquid material, to be mixed together in step (e) are separately introduced into the receptacle respectively through said at least one opening for introducing solid material and said at least one opening for introducing liquid material.

16. The method of claim 11, wherein:

during at least some of the time that step (e) is being conducted, said pressing plate is pressing said materials against said closure sufficiently to pressurize said materials so that during said time said materials are being mixed under pressure.

17. The method of claim 11, wherein:

during at least some of the time that step (e) is being conducted, said materials are being mixed under pressure in said confined space.

18. The mixing device of claim 13, wherein:

said at least one closable opening is constituted by at least two openings including at least one for introducing a solid material to be mixed and at least another for introducing a liquid material to be mixed, so that solid and liquid materials to be mixed can be separately introduced into the receptacle to be mixed in the confined space.

* * * * *